US010766268B2

(12) United States Patent
Hiruma

(10) Patent No.: US 10,766,268 B2
(45) Date of Patent: Sep. 8, 2020

(54) FILTER UNIT, LIGHT SOURCE UNIT, PRINTER

(71) Applicant: SEIKO EPSON CORPORATION, Tokyo (JP)

(72) Inventor: Daisuke Hiruma, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/283,061

(22) Filed: Feb. 22, 2019

(65) Prior Publication Data

US 2019/0263133 A1 Aug. 29, 2019

(30) Foreign Application Priority Data

Feb. 23, 2018 (JP) ..... 2018-030480

(51) Int. Cl.

| | |
|---|---|
| ***B41J 2/175*** | (2006.01) |
| ***B41J 29/02*** | (2006.01) |
| ***B41J 29/377*** | (2006.01) |
| ***B41J 29/38*** | (2006.01) |
| ***B41J 2/17*** | (2006.01) |
| *B41J 2/14* | (2006.01) |

(52) U.S. Cl.

CPC ..... *B41J 2/17563* (2013.01); *B41J 2/1714* (2013.01); *B41J 29/02* (2013.01); *B41J 29/377* (2013.01); *B41J 29/38* (2013.01); *B41J 2002/14403* (2013.01)

(58) Field of Classification Search

CPC ..... B41J 2/1714; B41J 2/17563; B41J 2002/14403; B41J 29/02; B41J 29/377; B41J 29/38

See application file for complete search history.

(56) References Cited

U.S. PATENT DOCUMENTS

| | | | | |
|---|---|---|---|---|
| 5,774,141 | A * | 6/1998 | Cooper | B41J 2/1714 347/34 |
| 9,739,662 | B2 * | 8/2017 | Kanai | G01J 3/26 |
| 2006/0066698 | A1 * | 3/2006 | Takatsuka | B41J 2/17563 347/93 |
| 2014/0292920 | A1 | 10/2014 | Shibata et al. | |

FOREIGN PATENT DOCUMENTS

| | | | |
|---|---|---|---|
| JP | 2014-188927 | A | 10/2014 |

* cited by examiner

*Primary Examiner* — Anh T Vo
(74) *Attorney, Agent, or Firm* — Workman Nydegger

(57) ABSTRACT

A filter unit is a filter unit disposed in a printer including a control unit, and includes a filter configured to trap a foreign material, a frame configured to hold the filter, and a storage element provided on the frame and capable of transmitting/receiving information about the filter to and from the control unit.

4 Claims, 13 Drawing Sheets

FILTER UNIT, LIGHT SOURCE UNIT, PRINTER

BACKGROUND

1. Technical Field

The present invention relates to a filter unit, a light source unit, and a printer.

2. Related Art

In the related art, an ultraviolet irradiation unit including an ultraviolet irradiation part and a fan for cooling the ultraviolet irradiation part has been known. Further, the above-described ultraviolet irradiation unit is provided with a filter for trapping ink mists (for example, see JP-A-2014-188927).

In the above-described ultraviolet irradiation unit, when the filter is clogged, cooling efficiency of the ultraviolet irradiation part lowers, and the ultraviolet irradiation part deteriorates, thus the filter needs to be replaced at an appropriate time.

However, for the above-described ultraviolet irradiation unit, there has been a problem that it is not possible to easily grasp when to replace the filter.

SUMMARY

A filter unit according to an aspect of the present application is a filter unit disposed in a printer including a control unit, the filter unit including a filter configured to trap a foreign material, a frame configured to hold the filter, and a storage element provided on the frame and capable of transmitting/receiving information about the filter to and from the control unit.

In the above-described filter unit, the frame is preferably formed in a rectangular shape, and the filter and the storage element are preferably disposed in parallel along a short-side direction.

In the above-described filter unit, a coupling portion electrically coupled to the storage element, and configured to be electrically coupled to the control unit, is preferably disposed at a central portion in a long-side direction of the frame.

A light source unit according to an aspect of the present application is a light source unit disposed in a printer including a control unit, the light source unit including a housing, a light source disposed in the housing and configured to radiate an ultraviolet ray, a driving circuit configured to drive the light source, a temperature detecting element configured to measure an ambient temperature of the light source, and a storage element capable of transmitting/receiving information about the light source to and from the control unit. The housing includes an inlet configured to take in outside air and an outlet configured to discharge outside air taken in, and the storage element is disposed closer to the inlet than to the light source.

In the above-described light source unit, the temperature detecting element is preferably disposed closer to the outlet than to the light source.

A printer according to an aspect of the present application includes the above-described filter unit or the above-described light source unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary embodiments of the invention will be described below with reference to the drawings. Note that, in each of the figures below, to illustrate each of members and the like in a recognizable size, each of the members and the like is illustrated to a scale different from an actual scale.

First Exemplary Embodiment

Firstly, a configuration of a printer will be described. The printer is, for example, an ink jet-type printer. Note that, in the description of the exemplary embodiment, a large format printer (LFP) configured to handle a relatively large medium will be used as an example of the configuration of the printer.

Figure 1:
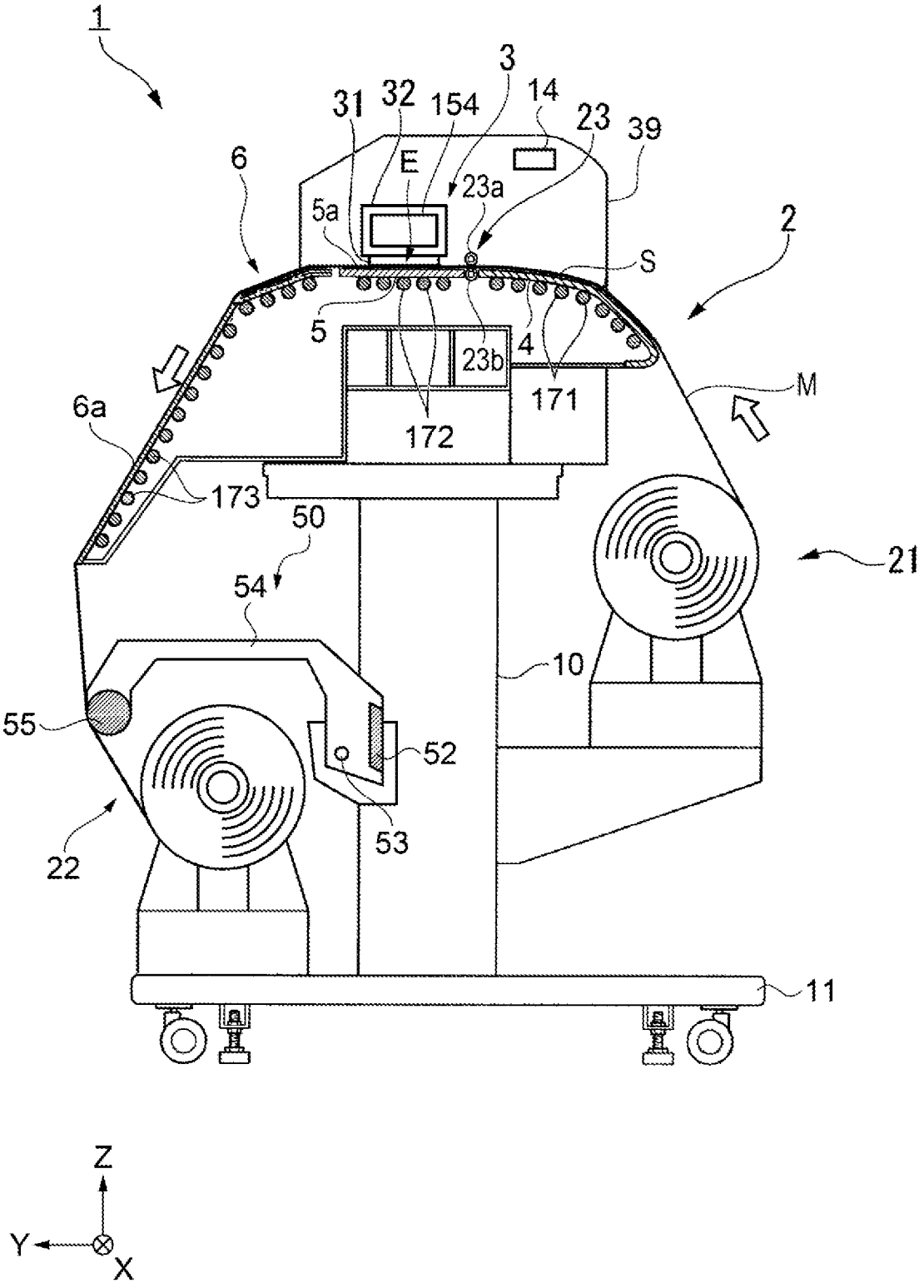
FIG. 1 is a schematic view illustrating a configuration of a printer according to First Exemplary Embodiment.

FIG. 1 is a schematic view (partial side sectional view) illustrating a configuration of the printer. As illustrated in FIG. 1, a printer 1 includes a conveying unit 2 for transporting a medium M, and a printing unit 3 including a recording head 31 capable of discharging (ejecting) ink as droplets as an example of liquid toward the medium M. Further, a tension adjustment unit 50 capable of applying tension on the medium M by contacting the medium M is included. Additionally, a control unit 14 for controlling the conveying unit 2, the printing unit 3, and the like are included. Additionally, the printer 1 includes operation panel units such as an operating unit for a user to instruct driving of each constitutional component and a display panel for checking a driving state.

Note that, these constitutional components are supported by a main body frame 10 disposed in a substantially vertical direction. Further, the main body frame 10 is coupled to a base unit 11 supporting the main body frame 10.

The conveying unit 2 transports the medium M in a transport direction (an outlined arrow direction in the figure) . In the exemplary embodiment, the medium M is transported with a roll-to-roll method. The conveying unit 2 includes a roll unit 21 for delivering the medium M having a roll shape in the transport direction, and a roll unit (reel unit) 22 capable of winding the delivered medium M.

On a downstream side in the transport direction of the medium M with respect to the roll unit 21, a first transport guide unit 4 including a first support face S supporting the medium M, a second transport guide unit 5 provided on the downstream side in the transport direction of the medium M with respect to the first transport guide unit 4 and including a second support face (platen) 5*a* supporting the medium M, and further, a third transport guide unit 6 provided on the downstream side in the transport direction of the medium M with respect to the second transport guide unit 5 and including a third support face 6*a* supporting the medium M are included. Additionally, the medium M delivered from the roll unit 21 is transported to the roll unit 22, via the first transport guide unit 4, the second transport guide unit 5, and the third transport guide unit 6. Further, the second support face 5*a* of the second transport guide unit 5 is disposed to face the recording head 31. That is, the second support face 5*a* is disposed to be capable of supporting the medium M in a discharging area E in which ink is discharged from the recording head 31 (printing unit 3).

Additionally, a transport path of the medium M between the first transport guide unit 4 and the second transport guide unit 5 is provided with a pair of transport rollers 23 for transporting the medium M. The pair of transport rollers 23 includes a first roller 23*a* and a second roller 23*b* disposed below the first roller 23*a*. The first roller 23*a* is a driven roller, and the second roller 23*b* is a driving roller.

The first transport guide unit 4 is disposed with a heater 171 capable of heating the medium M. The heater 171 in the exemplary embodiment is disposed on a surface (back surface) side on an opposite side to the first support face S of the first transport guide unit 4. The heater 171 is, for example, a tube heater, and is attached to the back surface of the first transport guide unit 4 by aluminum tape or the like. Additionally, by driving the heater 171, the first support face S supporting the medium M in the first transport guide unit 4 is heated by heat conduction, and the medium M can be heated from a back side of the medium M. Note that, similarly, the second transport guide unit 5 is disposed with a heater 172 on a surface (back surface) side on an opposite side to the second support face 5*a* of the second transport guide unit 5. A configuration of the heater 172 is identical to a configuration of the heater 171. Similarly, the third transport guide unit 6 is disposed with a heater 173 on a surface (back surface) side on an opposite side to the third support face 6*a* of the third transport guide unit 6. A configuration of the heater 173 is similar to the configuration of the heater 171.

Note that the heaters 171, 172, and 173 may be omitted. Further, although respective installation locations of the heaters 171, 172, and 173 are arranged on the surface (back surface) side on the opposite side to the first support face S, the surface (back surface) side on the opposite side to the second support face 5*a*, and the surface (back surface) side on the opposite side to the third support face 6*a* of the third transport guide unit 6, the invention is not limited thereto, and, for example, the respective locations may be arranged on the first support face S side, the second support face 5*a* side, or the third support face 6*a* side, and may have a configuration capable of heating a printed face of the medium M.

The printing unit 3 records (prints) images, characters, and the like on the medium M. Specifically, the printing unit 3 includes the recording head (ink jet head) 31 capable of discharging ink as droplets to the medium M, and a carriage 32 mounted with the recording head 31 and capable of freely reciprocating in a width direction (X axis direction) of the medium M. Additionally, the printer 1 includes a frame body 39, and the recording head 31 and the carriage 32 are disposed inside the frame body 39.

The recording head 31 includes a nozzle capable of discharging droplets, and can make the nozzle discharge ink as droplets, by driving a piezoelectric element as a driving element. Accordingly, images and the like can be recorded on the medium M. Additionally, in the discharging area E, a pressing unit (not illustrated) for pressing the medium M supported by the second support face 5*a* from above to the second support face 5*a* side is included, and in a state where lifting or the like of the medium M on the second support face 5*a* is suppressed, the recording head 31 is made to discharge droplets. This makes it possible to land the droplets on an accurate location, and to improve image quality.

Note that, as the ink according to the exemplary embodiment, an ultraviolet cure type ink that is promoted to cure by irradiation with ultraviolet is used as an example for explanation.

The printing unit 3 includes an ultraviolet irradiation unit 154. The ultraviolet irradiation unit 154 includes an ultraviolet irradiation part 101 (see FIG. 3) for radiating ultraviolet rays, and can promote curing of the ultraviolet cure type ink applied on the medium M, by the ultraviolet rays emitted from the ultraviolet irradiation part 101. Note that, a detailed configuration of the printing unit 3 including the ultraviolet irradiation unit 154 will be described later.

Additionally, a configuration of the recording head 31 is not limited to the above-described configuration. As a means for generating a pressure, for example, a so-called electrostatic type actuator or the like configured to generate static electricity between a vibration plate and an electrode to deform the vibration plate by electrostatic force, and to cause nozzles to discharge droplets may be used. Further, the configuration may include a droplet discharging head configured to use a heating element to generate bubbles in nozzles, and to cause the nozzles to discharge ink as droplets by the bubbles.

The tension adjustment unit 50 can apply tension on the medium M. The tension adjustment unit 50 in the exemplary embodiment is disposed to be capable of applying the tension on the medium M between the third transport guide unit 6 and the roll unit 22. The tension adjustment unit 50 includes a pair of frame units 54, and is configured to be capable of rotating around a rotation shaft 53. Additionally, a tension bar 55 is disposed between respective one ends of the pair of frame units 54. The tension bar 55 is formed to be longer in a width direction (X axis direction) than a width dimension of the medium M. Additionally, part of the tension bar 55 is configured to contact the medium M and to apply the tension on the medium M. On the other hand, a weight unit 52 is disposed between respective other ends of the pair of frame units 54. Accordingly, by rotating the tension adjustment unit 50 around the rotation shaft 53, a location of the tension adjustment unit 50 can be displaced.

Figure 2:
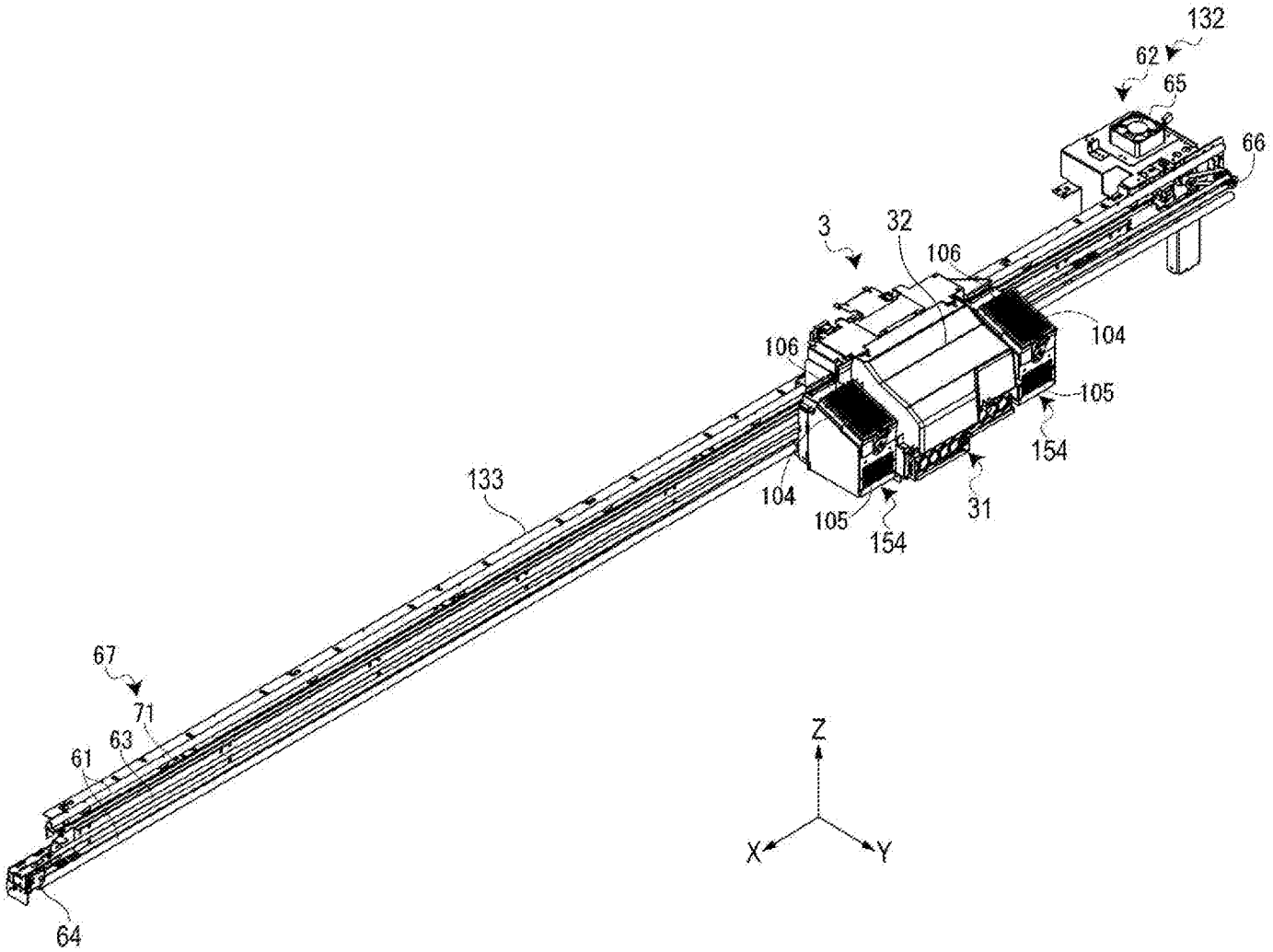
FIG. 2 is a perspective view illustrating a configuration of a printing unit according to First Exemplary Embodiment.

Next, a configuration of the printing unit will be described. FIG. 2 is a perspective view illustrating a configuration of the printing unit.

As illustrated in FIG. 2, the printing unit 3 includes the carriage 32 facing the medium M, an X axis moving unit 132 supporting the carriage 32 at a back side and moving the carriage 32 in the X axis direction, and a horizontal frame 133 supporting the X axis moving unit 132. The horizontal frame 133 extends in the X axis direction.

The X axis moving unit 132 includes a pair of upper and lower guide shafts 61 supported by the horizontal frame 133 and supporting the carriage 32 such that the carriage 32 can freely reciprocate in the X axis direction, an X axis driving mechanism 62 directly driving the carriage 32 along the pair of guide shafts 61, and an X axis detection mechanism 67 detecting a movement location of the carriage 32 in the X axis direction.

The X axis driving mechanism 62 includes a timing belt 63 extending in the X axis direction along the pair of guide shafts 61, a driving pulley 66 and a driven pulley 64 that bridge the timing belt 63, a coupling and fixing unit (not illustrated) coupling the timing belt 63 and the carriage 32, and a carriage motor 65 driving the driving pulley 66. The X axis moving unit 132 rotates the carriage motor 65 forward/backward, to reciprocate the carriage 32 in the X axis direction on the pair of guide shafts 61 via the timing belt 63.

The X axis detection mechanism 67 includes a linear scale 71 provided along the X axis direction, and a detector (not illustrated), fixed on the carriage 32, that reads scale marks of the linear scale 71 and detects the movement location of the carriage 32.

An end portion in a −Z axis direction of the carriage 32 is disposed with the recording head 31. Additionally, each of both end portions in the X axis direction of the carriage 32 is disposed with the ultraviolet irradiation unit 154. Accordingly, together with movement of the carriage 32, the recording head 31 and the ultraviolet irradiation unit 154 move as well.

Figure 3:
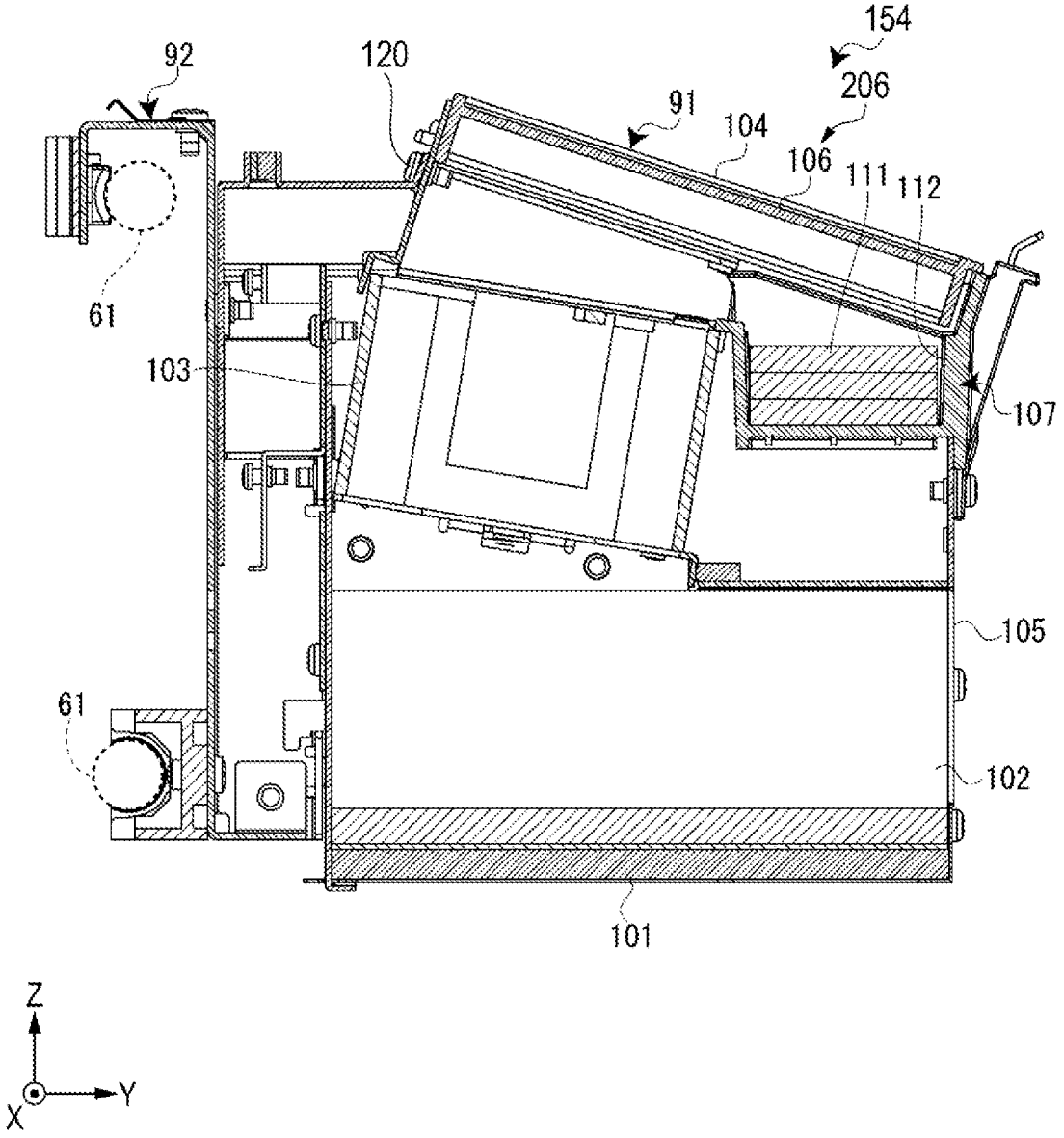
FIG. 3 is a cross sectional view illustrating a configuration of an ultraviolet irradiation unit according to First Exemplary Embodiment.

Next, a configuration of the ultraviolet irradiation unit will be described. FIG. 3 is a cross-sectional view illustrating a configuration of the ultraviolet irradiation unit.

As illustrated in FIG. 3, each ultraviolet irradiation unit 154 includes an irradiation unit body 91, and a mounting member 92 disposed on a back side of the irradiation unit body 91 and mounted on the irradiation unit body 91 on the pair of guide shafts 61 such that the irradiation unit body 91 can freely slide.

The irradiation unit body 91 includes the ultraviolet irradiation part (electromagnetic wave irradiation unit) 101 facing the medium M, a fin type heatsink 102 disposed on an upper portion of the ultraviolet irradiation part 101 and cooling the ultraviolet irradiation part 101, a cooling fan 103 disposed on an upper side of the heatsink 102 and generating an airflow passing through the heatsink 102, and an inlet 104 and an outlet 105 disposed on an upper portion and on a lower front side for air intake and exhaust, respectively. The ultraviolet irradiation part 101 is configured with a plurality of ultraviolet irradiation LEDs radiating ultraviolet rays (electromagnetic waves), and is disposed on a lower portion of the irradiation unit body 91 and facing downward. Each ultraviolet irradiation unit 154 uses the ultraviolet irradiation part 101, radiating an ultraviolet cure type ink discharged on the medium M by the recording head 31 with ultraviolet rays, to cure (fix) the ultraviolet cure type ink.

Additionally, the irradiation unit body 91 includes a filter unit 206 disposed on the inlet 104 and including a filter 106 trapping ink mists, and an ink storage unit 107 fronting (facing) a lower end portion of the filter 106. The filter unit 206 is disposed above a housing 120 dividing the ultraviolet irradiation unit 154. The irradiation unit body 91 is formed with an inner flow path communicating the inlet 104 with the outlet 105, and the inlet 104 and the filter 106, the fan 103, the heatsink 102, and the outlet 105 are disposed in this order from an upstream side. By driving the fan 103, an atmosphere containing ink mists is taken in from the inlet 104, and exhausted from the outlet 105 through the filter 106 and the heatsink 102. As described above, the ultraviolet irradiation unit 154 functions as a mist collecting unit that takes in an atmosphere around the recording head 31, traps the ink mists, and exhausts the atmosphere. Note that, these ink mists are generated along with ink discharging by the recording head 31.

The inlet 104 is disposed on an upper portion of the irradiation unit body 91, and also is disposed facing upward and forward, that is, obliquely upward. That is, the inlet 104 is disposed to be inclined with respect to a horizontal plane. On the other hand, the outlet 105 is disposed on a lower front side of the irradiation unit body 91, and also is disposed facing forward.

The filter 106 is disposed on the inlet 104, and is disposed facing obliquely upward according to the inlet 104. Additionally, the filter 106 extends forward to a portion directly above the ink storage unit 107.

The ink storage unit 107 is disposed to face a lower end portion of the filter 106. The ink storage unit 107 includes a storage container 111 for receiving and storing ink discharged from the lower end portion of the filter 106, and an absorber 112 filled in the storage container 111. As the filter 106 traps ink mists and ink is collected on the filter 106, the collected ink is gathered to the lower end portion of the filter 106, and subsequently reaches the ink storage unit 107 and is stored.

Figure 4:
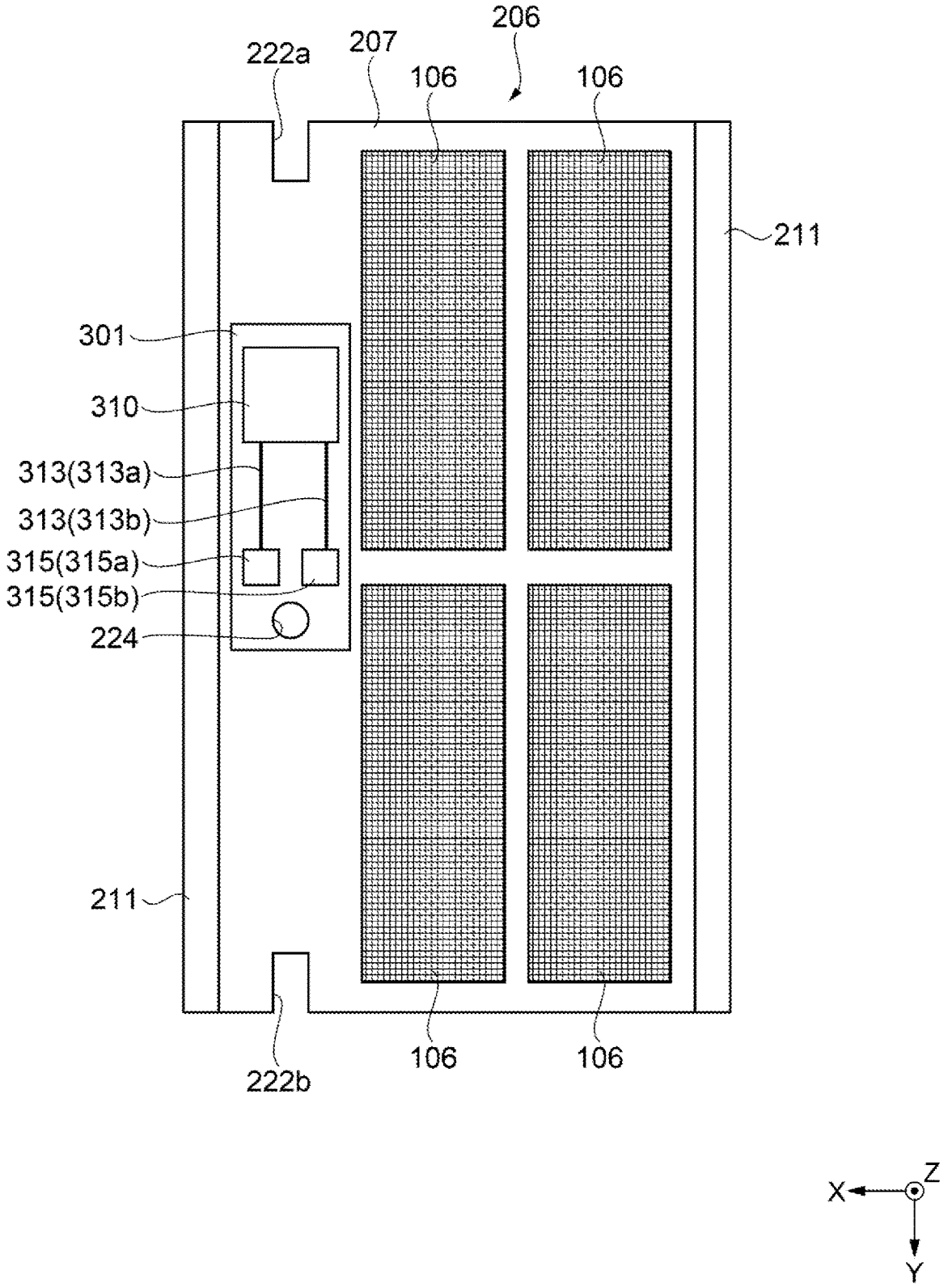
FIG. 4 is a plan view illustrating a configuration of a filter unit according to First Exemplary Embodiment.

Next, a configuration of the filter unit will be described. FIG. 4 is a plan view illustrating a configuration of the filter unit, and FIG. 5 is a side view illustrating the configuration of the filter unit.

Figure 5:
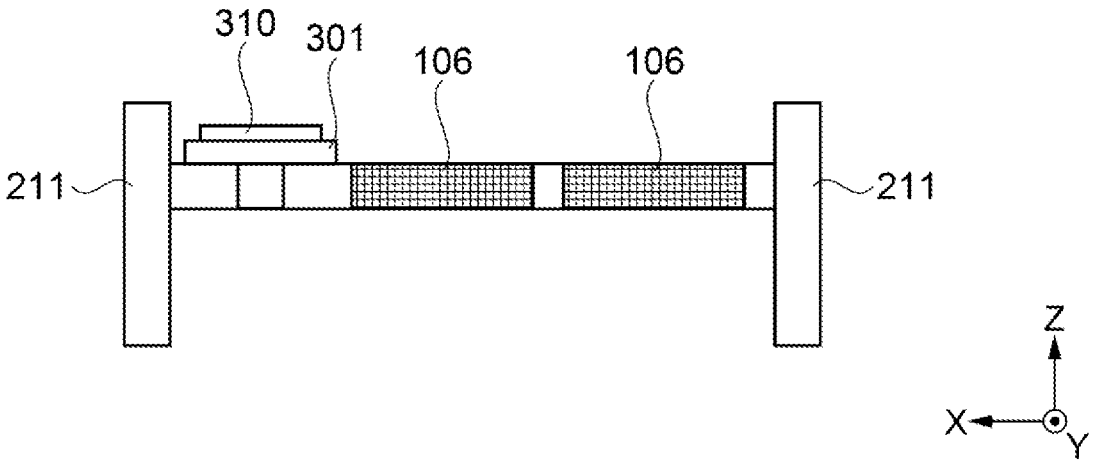
FIG. 5 is a side view illustrating the configuration of the filter unit according to First Exemplary Embodiment.

As illustrated in FIG. 4 and FIG. 5, the filter unit 206 includes the filter 106 for trapping foreign materials such as ink mists, and a frame 207 for holding the filter 106. As the filter 106, non-woven fabric, glass wool, rock wool, or the like can be used. Further, metal woven wire nettings may be used.

Additionally, the frame 207 is provided with a substrate 301 mounted with a storage element 310. The frame 207 and the substrate 301 may be bonded to each other with an adhesive or the like, or may be coupled to each other with a fixing tool such as a screw. The storage element 310 stores information about the filter 106, and is configured to be capable of transmitting/receiving the information about the filter 106 to and from the control unit 14.

As the information about the filter 106 stored in the storage element 310, for example, a component name, a manufacturing part number, a grade (e.g., mesh-size), a manufacturing division, a manufacturing number, and the like, are recorded. Additionally, history information such as an installation date, operation time (installation time of the filter 106), or the like of the filter 106 is recorded and updated between the control unit 14 and the storage element 310.

The frame 207 in the exemplary embodiment has a rectangular outer shape. The frame 207 is formed of a resin material, a metal material, or the like, for example. Additionally, the filter 106 and the storage element 310 are arranged in parallel along a short-side direction (the X axis direction) of the frame 207. Accordingly, the filter 106 and the storage element 310 (substrate 301) can be efficiently disposed on the frame 207.

On the substrate 301, lands 315 (e.g., lands 315*a*, 315*b* in the exemplary embodiment) electrically coupled to the storage element 310 via conducting wires 313 (conducting wires 313*a*, 313*b* in the exemplary embodiment) and configured to be electrically coupled to the control unit 14 are disposed. The lands 315 are made of metal. The lands 315 in the exemplary embodiment are disposed at a central portion in a long-side direction (Y axis direction) of the frame 207.

Additionally, both end portions of the frame 207 are provided with plate-shaped supporting bodies 211 supporting the frame 207, respectively. In the exemplary embodiment, the supporting bodies 211 are disposed on both of the end portions in the short-side direction (X axis direction) of the frame 207, respectively. Additionally, the frame 207 is coupled to a central portion in a Z axis direction of the supporting body 211 (see FIG. 5).

Further, the frame 207 is formed with locating grooves 222*a*, 222*b* and a locating hole 224 such that the frame 207 is coupled to a body side (housing 120) of the ultraviolet irradiation unit 154 at precise locations. The locating grooves 222*a*, 222*b* are formed on end portions in the Y axis direction of the frame 207, respectively. Additionally, the locating hole 224 is provided on the central portion in the Y axis direction of the frame 207. Note that, the locating hole 224 is a through-hole penetrating the frame 207 and the substrate 301. In the exemplary embodiment, the locating grooves 222*a*, 222*b* and the locating hole 224 are disposed substantially in a straight line along the Y axis direction of the frame 207.

Figure 6:
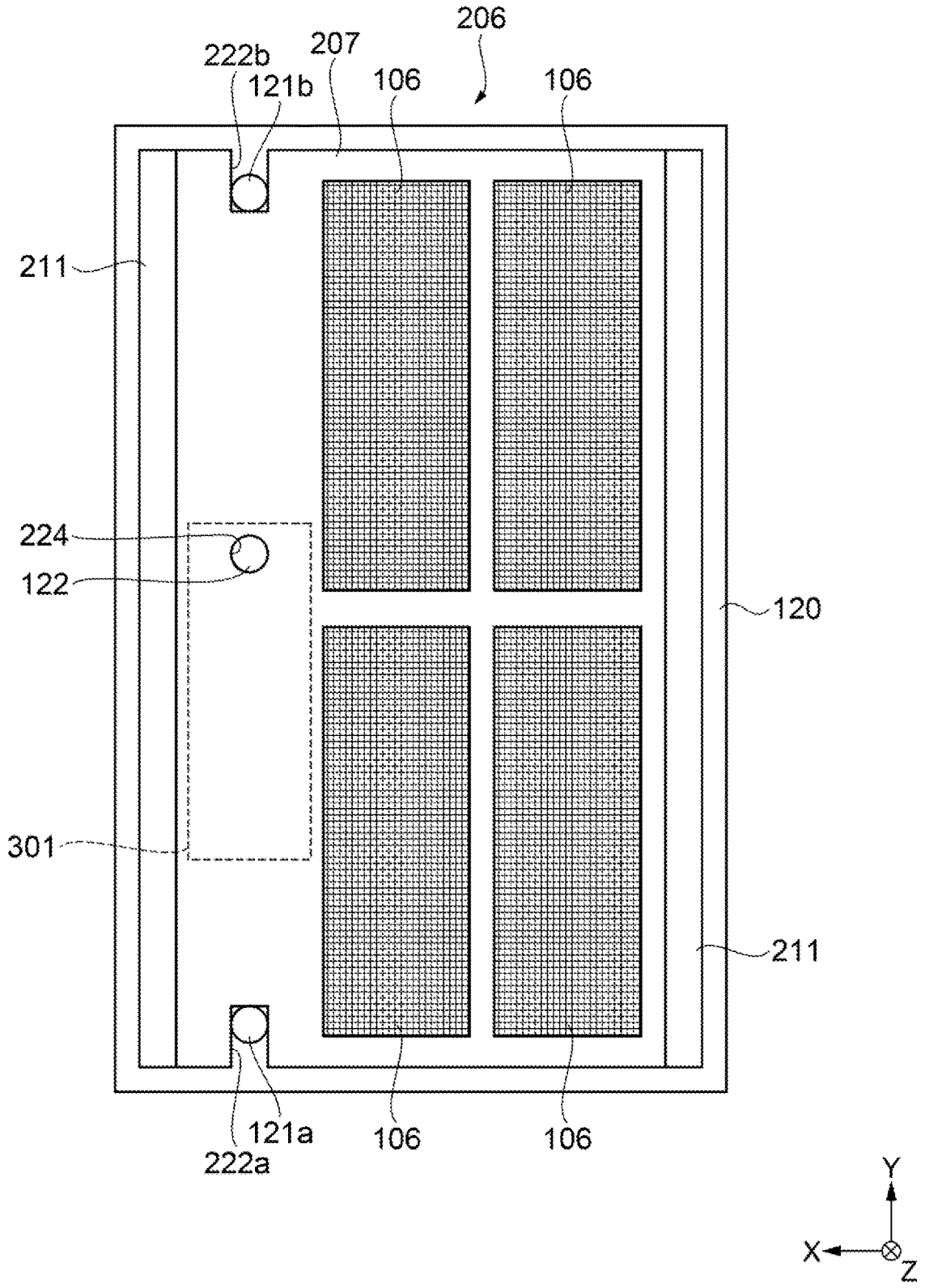
FIG. 6 is an explanatory view illustrating an installation method of the filter unit according to First Exemplary Embodiment.

Next, an installation method of the filter unit will be described. Specifically, an installation method of the filter unit in the ultraviolet irradiation unit will be described. FIG. 6 is a plan view illustrating the installation method of the filter unit, and FIG. 7 is a side view illustrating the installation method of the filter unit.

Figure 7:
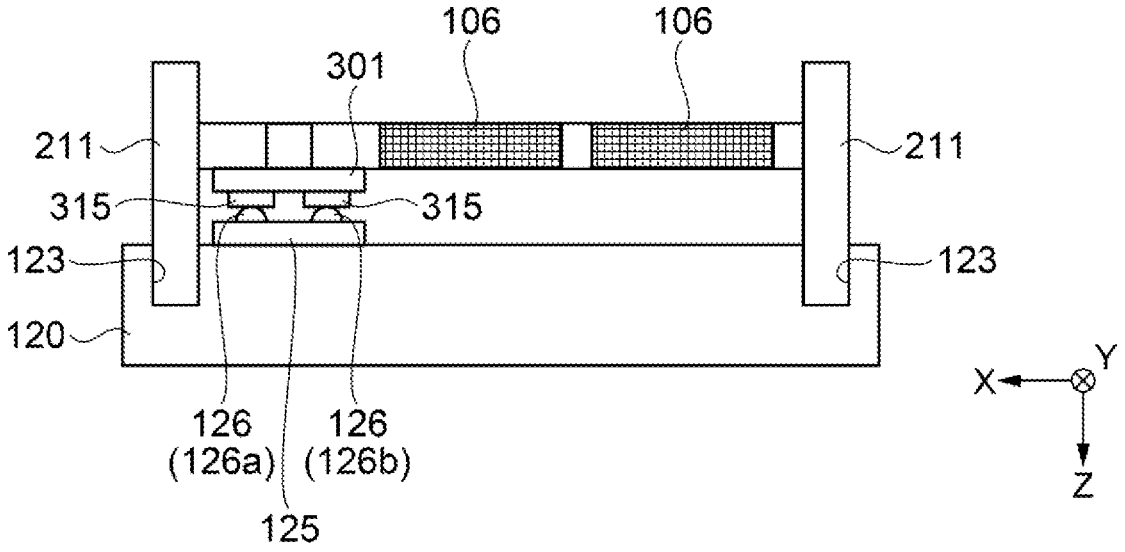
FIG. 7 is an explanatory view illustrating the installation method of the filter unit according to First Exemplary Embodiment.

As illustrated in FIG. 6 and FIG. 7, the filter unit 206 is installed above the housing 120 dividing the ultraviolet irradiation unit 154. On an upper part of the housing 120, a locating pin 121*a* corresponding to the locating groove 222*a* of the filter unit 206, a locating pin 121*b* corresponding to the locating groove 222*b*, and a locating pin 122 corresponding to the locating hole 224 are installed. Further, on the upper part of the housing 120, recessed portions 123, in which the respective supporting bodies 211 of the filter unit 206 are inserted, are provided.

Further, on the upper part of the housing 120, a coupling portion 125 electrically coupled to the lands 315 of the filter unit 206 is provided. Additionally, the coupling portion 125 is disposed with contact point portions 126 (contact point portions 126*a*, 126*b* in the exemplary embodiment) that can contact the respective lands 315 (315*a*, 315*b*). The contact point portions 126 are electrically coupled to the control unit 14 via coupling wiring (not illustrated).

Further, the filter unit 206 is disposed on the housing 120 such that the lands 315 of the filter unit 206 face the housing 120, that is, in a state where the substrate 301 of the filter unit 206 faces the −Z axis direction. Accordingly, the locating pin 121*a* is fitted in the locating groove 222*a*, the locating pin 121*b* is fitted in the locating groove 222*b*, and the locating pin 122 is fitted in the locating hole 224. Further, the respective supporting bodies 211 are inserted in the recessed portions 123. Here, a Z axis direction location of the frame 207 is defined by a depth dimension of the recessed portion 123 in the Z axis direction in which the supporting body 211 is inserted. In the exemplary embodiment, the depth dimension of the recessed portion 123 in the Z axis direction is shorter (smaller) than a dimension from an end portion of the supporting body 211 in the Z axis direction to one surface of the frame 207. Accordingly, when the filter unit 206 is mounted on the housing 120, as illustrated in FIG. 7, the filter 106 does not contact the housing 120, and a space is formed between the filter 106 and the housing 120. Thus, for example, even when foreign materials such as ink mists attach to the housing 120, since the housing 120 does not contact the filter 106, attachment of the foreign materials to the filter 106 can be prevented.

Additionally, the land 315*a* contacts the contact point portion 126*a*, and the land 315*b* contacts the contact point portion 126*b*. Accordingly, the storage element 310 is electrically coupled to the control unit 14, and transmission/reception of the information about the filter 106 between the storage element 310 and the control unit 14 is enabled.

Additionally, since the lands 315*a*, 315*b* are disposed at a center in the long-side direction of the frame 207, by rotating the frame 207 by 180 degrees in a plan view, installation is possible on any one of the ultraviolet irradiation units 154 disposed in the X axis direction of the carriage 32.

Note that, the disposition locations of the lands 315 are not limited to the center in the long-side direction of the frame 207, and the lands 315 may be disposed line-symmetrically. Even with this configuration, similar handling as described above is possible.

Additionally, when the filter unit 206 is mounted on the housing 120, the substrate 301 and the housing 120 face each other. Thus, the substrate 301 is hidden by the frame 207, and it is not possible to visually recognize the substrate 301 by appearance. Accordingly, mistaken contact with the substrate 301 (including the storage element 310, the lands 315, and the like) by a user is prevented, and thus coupling between the land 315*a* and the contact point portion 126*a* can be maintained.

Figure 8:
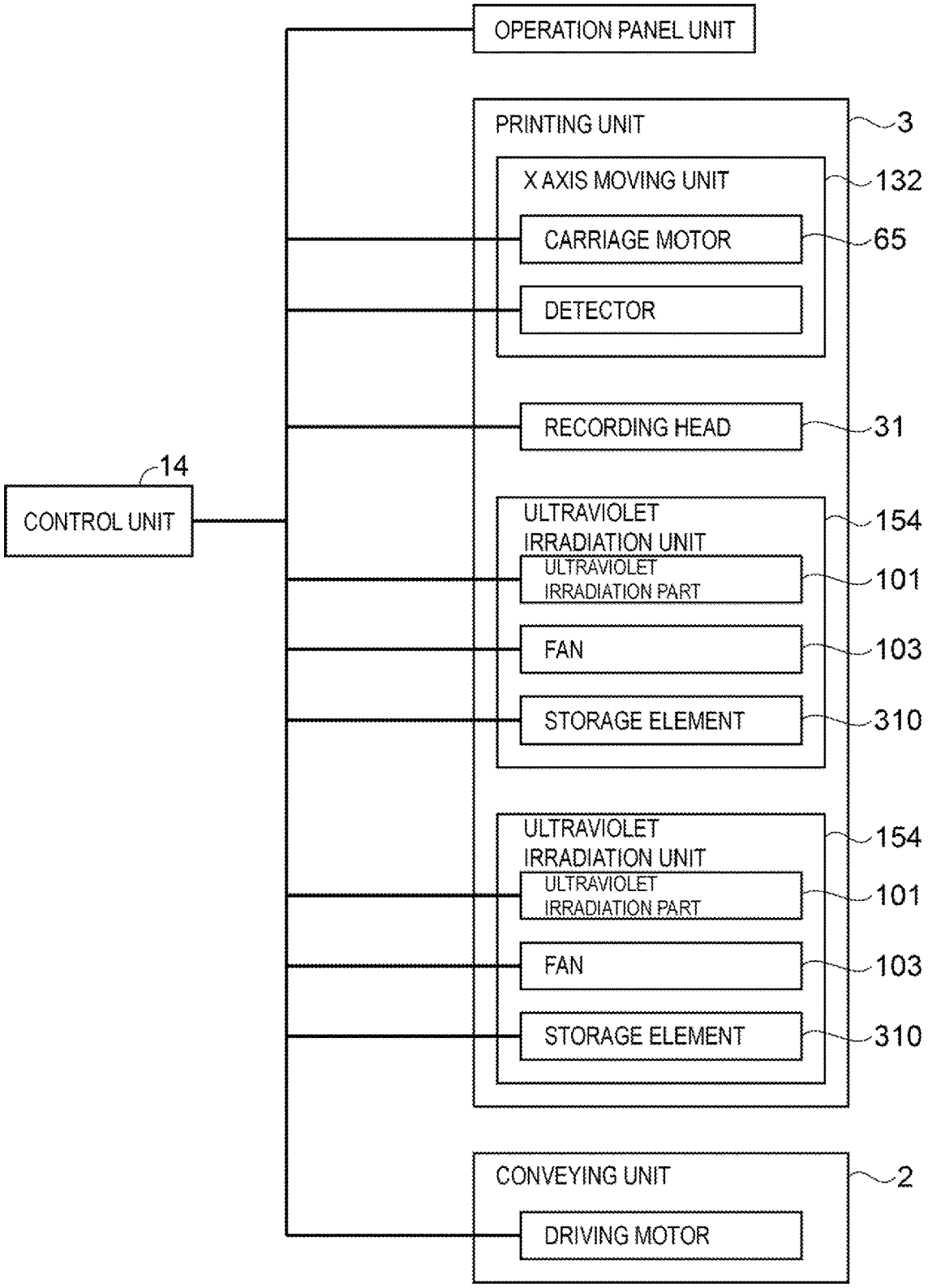
FIG. 8 is a block diagram illustrating a configuration of a control unit according to First Exemplary Embodiment.

Next, a configuration of the control unit will be described. FIG. 8 is a block diagram illustrating a configuration of the control unit. As illustrated in FIG. 8, the control unit 14 is coupled to the conveying unit 2, the printing unit 3, and the operation panel unit. The control unit 14 includes a Central Processing Unit (CPU) for executing various programs, a Random Access Memory (RAM) for temporarily storing data, programs, and the like, a Read Only Memory (ROM) in which various data, various programs, and the like are recorded in advance in a non-volatile manner, and an interface. Additionally, the CPU processes various signals inputted via the interface based on data in the RAM and the ROM, and outputs control signals to each unit via the interface. The control unit 14 receives operational information about user operations from the operation panel unit, and receives a detection result (movement location) from a detector of the X axis moving unit 132. On the other hand, the control unit 14 controls the carriage motor 65 of the X axis moving unit 132, the recording head 31, the ultraviolet irradiation part 101 and the fan 103 of each ultraviolet irradiation unit 154, and a driving motor of the conveying unit 2, to perform a recording operation (liquid discharging operation).

In the recording operation, the control unit 14 uses the conveying unit 2 to move the medium M intermittently. Additionally, at each stop time during the intermittent movement of the conveying unit 2, while the ultraviolet irradiation part 101 emits ultraviolet rays, the X axis moving unit 132 is used to move the recording head 31 (carriage 32) in the X axis direction, and the recording head 31 is made to discharge ink (recording process). Accordingly, a desired image is recorded on the medium M. At this time, in a state where each fan 103 is driven, the pair of ultraviolet irradiation units 154 reciprocates in the X axis direction together with the recording head 31 (carriage 32), thus the pair of ultraviolet irradiation units 154 collects ink mists in an entire region in the X axis direction in the frame body 39 covering the printing unit 3. That is, a mist collection operation (air intake and exhaust operation) is performed together with the recording operation in this configuration.

Here, the storage element 310 installed on the filter unit 206 of each ultraviolet irradiation unit 154 is coupled to the control unit 14. The control unit 14 reads information about the filter 106 (the component name, the manufacturing part number, the grade (e.g., mesh-size), the manufacturing division, the manufacturing number, and the like), recorded in the storage element 310 in advance, and displays the read information on the operation panel. Accordingly, whether the filter 106 supports the ink discharged from the recording head 31 can be checked. Additionally, for example, when the filter 106 does not support the ink discharged from the recording head 31, the filter 106 is replaced by a filter 106 that is adequate before the recording operation. This makes it possible to improve collection efficiency of the ink mists, enhance cooling efficiency of the ultraviolet irradiation part 101, and prevent deterioration of the ultraviolet irradiation part 101.

Further, the control unit 14, when the recording operation starts, periodically writes a cumulated time of recording operation time to the storage element 310. That is, the fan 103 is driven, and collection time of the ink mists by the filter 106 is cumulated. Then, for example, when a preset cumulated time of the recording operation (replacement time) is reached, the operation panel is made to display an instruction to replace the filter 106. Subsequently, a user, after considering a situation of the recording operation, stops driving the conveying unit 2 and the printing unit 3, and replaces the filter 106. Note that, the replacement time of the filter 106 may be indicated by a warning sound or a warning light, other than by displaying on the operation panel. Additionally, an LED may be disposed on the substrate 301, and when the preset cumulated time of the recording operation (replacement time) is reached, the LED may be turned on.

According to the exemplary embodiment, the following advantages can be obtained.

It is easy to acquire the information about the filter 106 via the storage element 310 coupled to the filter unit 206. Additionally, by acquiring the cumulated time that the filter 106 is used, when the predetermined cumulated time is reached, the filter 106 can be replaced. Accordingly, it is possible to easily grasp when to replace the filter 106. Accordingly, it is possible to maintain the cooling efficiency of the ultraviolet irradiation part 101, and prevent deterioration of the ultraviolet irradiation part 101.

Additionally, also when the filter 106 once used is used for another printer 1, a history of the filter 106 is stored in the storage element 310, and thus a user can easily check the information about the filter 106.

By mounting such a filter unit 206 in the printer 1, the printer 1 with high reliability can be provided.

Second Exemplary Embodiment

Next, Second Exemplary Embodiment will be described. In the above-described First Exemplary Embodiment, the embodiment in which the storage element 310 is installed on the filter unit 206 of the ultraviolet irradiation unit 154 was described, but in the exemplary embodiment, an embodiment in which the storage element 310 is installed on the ultraviolet irradiation part 101 will be described. Note that, a basic configuration of the printer 1 is identical, thus a description thereof will be omitted. Additionally, an identical configuration to that in First Exemplary Embodiment will be given an identical reference numeral and detailed description will be omitted.

Figure 9:
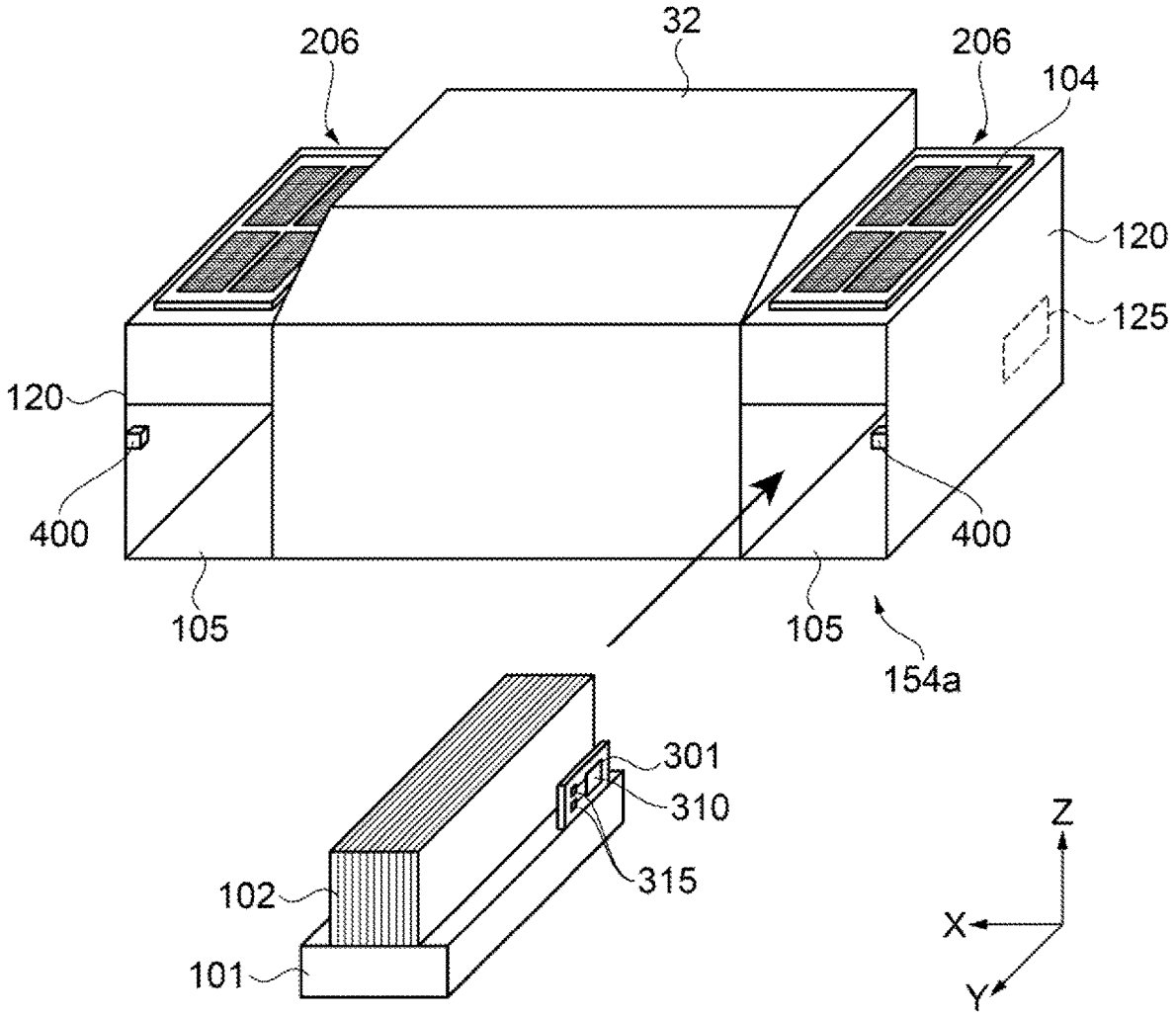
FIG. 9 is a schematic view illustrating a configuration of an ultraviolet irradiation unit (light source unit) according to Second Exemplary Embodiment.

FIG. 9 is a schematic view illustrating a configuration of an ultraviolet irradiation unit (light source unit) according to the exemplary embodiment. As illustrated in FIG. 9, an ultraviolet irradiation unit 154*a* includes the ultraviolet irradiation part 101 (light source). The ultraviolet irradiation part 101 is driven and controlled by the control unit 14 via a driving circuit. The heatsink 102 is provided on an upper portion of the ultraviolet irradiation part 101.

In the exemplary embodiment, the ultraviolet irradiation part 101 and the heatsink 102 are configured as one unit. Additionally, the ultraviolet irradiation part 101 and the heatsink 102 that are unitized are removably configured inside the housing 120 via an opening of the outlet 105. The ultraviolet irradiation part 101 and the heatsink 102 are removable by a slide mechanism with respect to the housing 120.

Additionally, the substrate 301 mounted with the storage element 310 is disposed on the upper portion of the ultraviolet irradiation part 101. The storage element 310 stores information about the ultraviolet irradiation part 101, and is configured to be capable of transmitting/receiving the information about the ultraviolet irradiation part 101 to and from the control unit 14.

As the information about the ultraviolet irradiation part 101 stored in the storage element 310, for example, a component name, a manufacturing part number, specifications, a manufacturing division, a manufacturing number, and the like, are recorded. Additionally, history information such as an installation date, operation time (driving time of the ultraviolet irradiation part 101), or the like of the ultraviolet irradiation part 101 is recorded and updated between the control unit 14 and the storage element 310.

Here, the ultraviolet irradiation part 101 is disposed inside the housing 120. Additionally, the storage element 310 is disposed closer to the inlet 104 side than the ultraviolet irradiation part 101. Further, the storage element 310 is disposed not near an opening of the outlet 105, but on a deeper side (−Y axis direction) of the housing 120. Accordingly, contacting of the storage element 310 with fingers of a user can be prevented. Additionally, since the lands 315 including the storage element 310 are disposed on a portion relatively far from the inlet 104, contamination of the lands 315 by a foreign material is reduced, and thus connectivity between the storage element 310 and the coupling portion 125 can be secured.

Further, the ultraviolet irradiation unit 154*a* includes a temperature detecting element 400 for measuring (detecting) an ambient temperature of the ultraviolet irradiation part 101. The temperature detecting element 400 is, for example, an IC temperature sensor, a thermocouple, a thermistor, or the like. Additionally, the temperature detecting element 400 is disposed closer to the outlet 105 side than the ultraviolet irradiation part 101. This makes the temperature detecting element 400 less susceptible to influence of outside air taken in the housing 120, and the ambient temperature of the ultraviolet irradiation part 101 can be reliably detected. Note that, the temperature detecting element 400 is preferably provided on a location that does not block ultraviolet rays emitted by the ultraviolet irradiation part 101, and is provided as close to the ultraviolet irradiation part 101 as possible. In this way, the ambient temperature of the ultraviolet irradiation part 101 can be more reliably detected.

Figure 10:
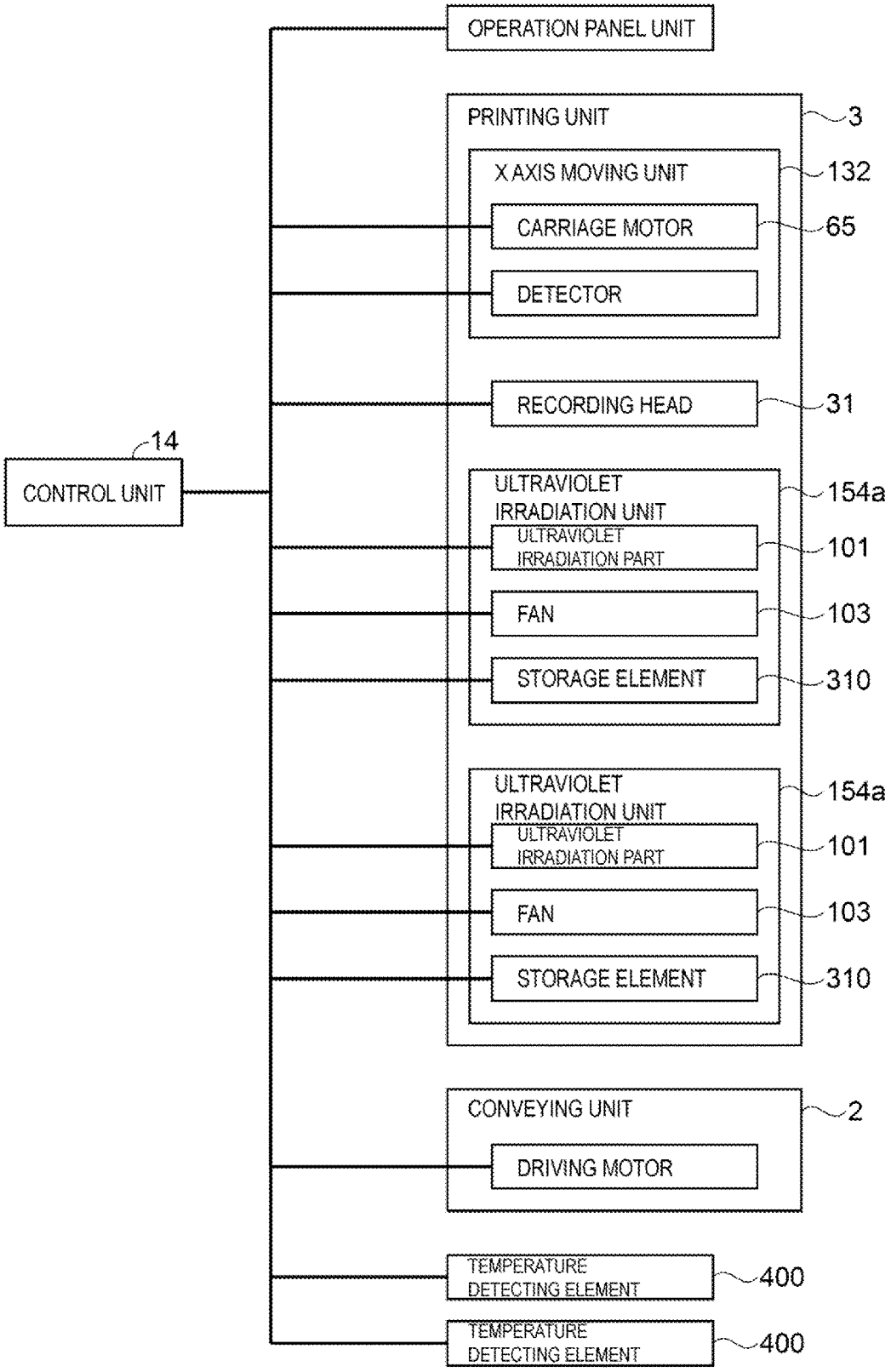
FIG. 10 is a block diagram illustrating a configuration of a control unit according to Second Exemplary Embodiment.

Next, a configuration of the control unit will be described. FIG. 10 is a block diagram illustrating a configuration of the control unit according to the exemplary embodiment.

As illustrated in FIG. 10, the control unit 14 is coupled to the conveying unit 2, the printing unit 3 and an operation panel unit, and further, to the temperature detecting element 400. The control unit 14 includes a Central Processing Unit (CPU) for executing various programs, a Random Access Memory (RAM) for temporarily storing data, programs, and the like, a Read Only Memory (ROM) in which various data, various programs, and the like are recorded in advance in a non-volatile manner, and an interface. Additionally, the CPU processes various signals inputted via the interface based on data in the RAM and the ROM, and outputs control signals to each unit via the interface.

The control unit 14 receives operational information about user operations from the operation panel unit, and receives a detection result (movement location) from a detector of the X axis moving unit 132. On the other hand, the control unit 14 controls the carriage motor 65 of the X axis moving unit 132, the recording head 31, the ultraviolet irradiation part 101 and the fan 103 of each ultraviolet irradiation unit 154, and a driving motor of the conveying unit 2, to perform a recording operation (liquid discharging operation).

Here, the storage element 310 installed on the ultraviolet irradiation part 101 of each ultraviolet irradiation unit 154*a* is coupled to the control unit 14. The control unit 14 reads information about the ultraviolet irradiation part 101 (the component name, the manufacturing part number, the specifications, the manufacturing division, the manufacturing number, and the like), recorded in the storage element 310 in advance, and displays the read information on the operation panel. Accordingly, whether the ultraviolet irradiation part 101 is applicable to the printer 1 can be checked.

Further, the control unit 14, when the recording operation starts, periodically writes a cumulated time of recording operation time to the storage element 310. That is, driving time of the ultraviolet irradiation part 101 is cumulated. Then, for example, when a preset cumulated time of the recording operation (replacement time) is reached, the ultraviolet irradiation part 101 is replaced. At this time, the operation panel is made to display an instruction to replace the ultraviolet irradiation part 101. Subsequently, a user, after considering a situation of the recording operation, stops the driving of the conveying unit 2 and the printing unit 3, and replaces the ultraviolet irradiation part 101.

Further, the control unit 14 acquires temperature detection data from the temperature detecting element 400. Accordingly, the ambient temperature of the ultraviolet irradiation part 101 is acquired. Additionally, by using a relational expression between the ambient temperature of the ultraviolet irradiation part 101 and the driving time of the ultraviolet irradiation part 101, the ultraviolet irradiation part 101 is replaced when a predetermined value is reached. Note that, the replacement time of the ultraviolet irradiation part 101 may be indicated by a warning sound or a warning light, other than by displaying on the operation panel.

According to the exemplary embodiment, the following advantages can be obtained.

It is easy to acquire the information about the ultraviolet irradiation part 101 via the storage element 310 coupled to the ultraviolet irradiation part 101. Additionally, information about the ambient temperature of the ultraviolet irradiation part 101 can be easily acquired by the temperature detecting element 400. Accordingly, for example, the ultraviolet irradiation part 101 can be replaced according to a relation between the cumulated operation time that the ultraviolet irradiation part 101 is operated and the ambient temperature of the ultraviolet irradiation part 101. Accordingly, it is possible to easily grasp when to replace the ultraviolet irradiation part 101. Additionally, it is possible to maintain quality of the ultraviolet irradiation part 101, and improve image quality.

Additionally, also when the ultraviolet irradiation part 101 once used is used for another printer 1, a history of the ultraviolet irradiation part 101 is stored in the storage element 310, and thus a user can easily check the information about the ultraviolet irradiation part 101.

Additionally, by mounting the ultraviolet irradiation unit 154*a* in the printer 1, the printer 1 with high reliability can be provided.

Note that, the invention is not limited to the above-described exemplary embodiment, and various changes and improvements can be made to the above-described exemplary embodiment. Such modified examples are described below.

Modified Example 1

Figure 11:
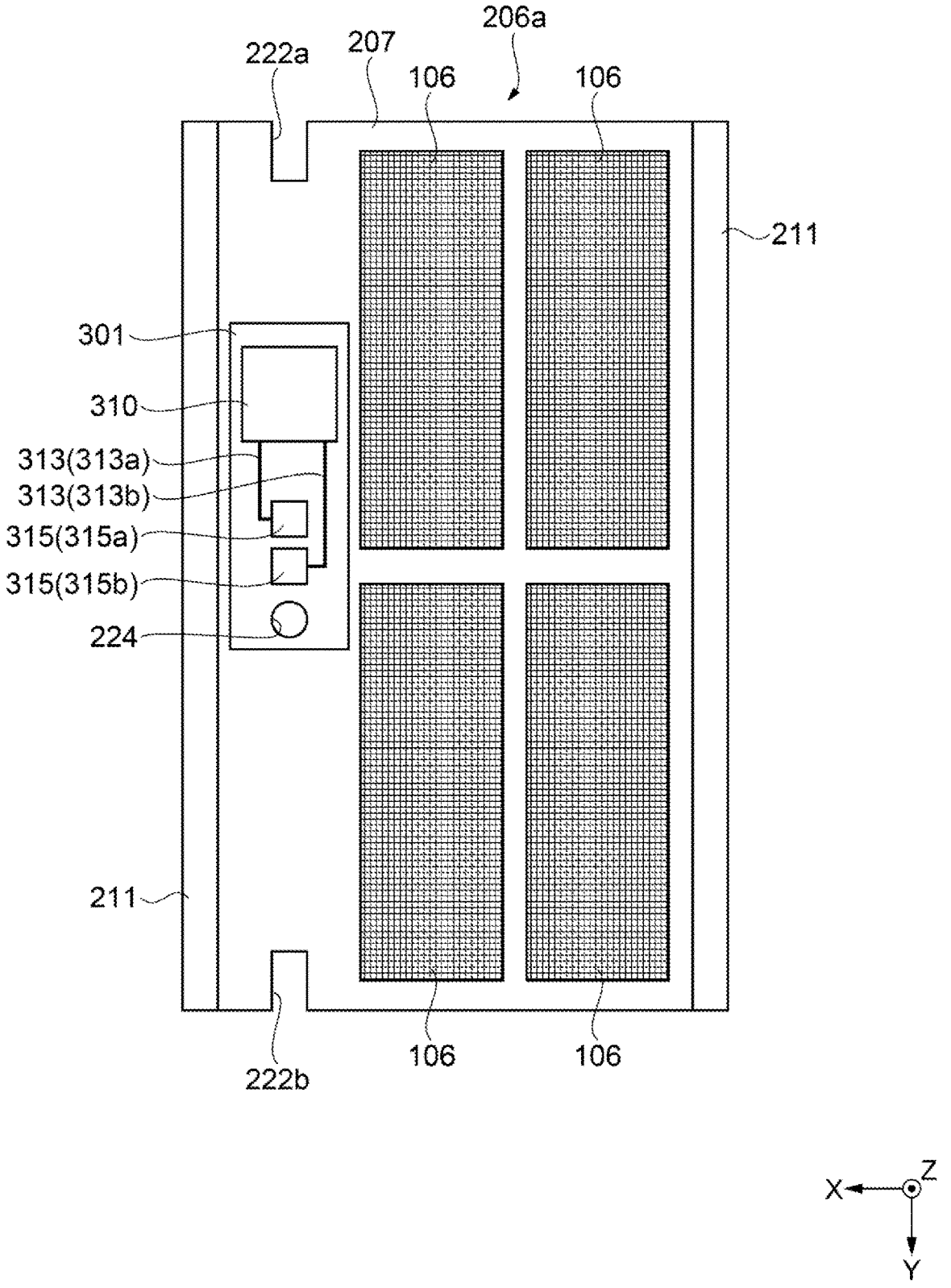
FIG. 11 is a plan view illustrating a configuration of a filter unit according to Modified Example 1.

In the above-described exemplary embodiments, the lands 315*a*, 315*b* on the substrate 301 were disposed in parallel in the X axis direction, but the invention is not limited thereto. FIG. 11 is a plan view illustrating a configuration of a filter unit according to the modified example. As illustrated in FIG. 11, in a filter unit 206*a*, the lands 315*a*, 315*b* on the substrate 301 are disposed in parallel in the Y axis direction. Even with this configuration, similar advantages as described above can be obtained. In addition, a size of the substrate 301 can be further reduced. Note that, other configurations are similar to those in First Exemplary Embodiment, thus descriptions thereof will be omitted.

Modified Example 2

Figure 12:
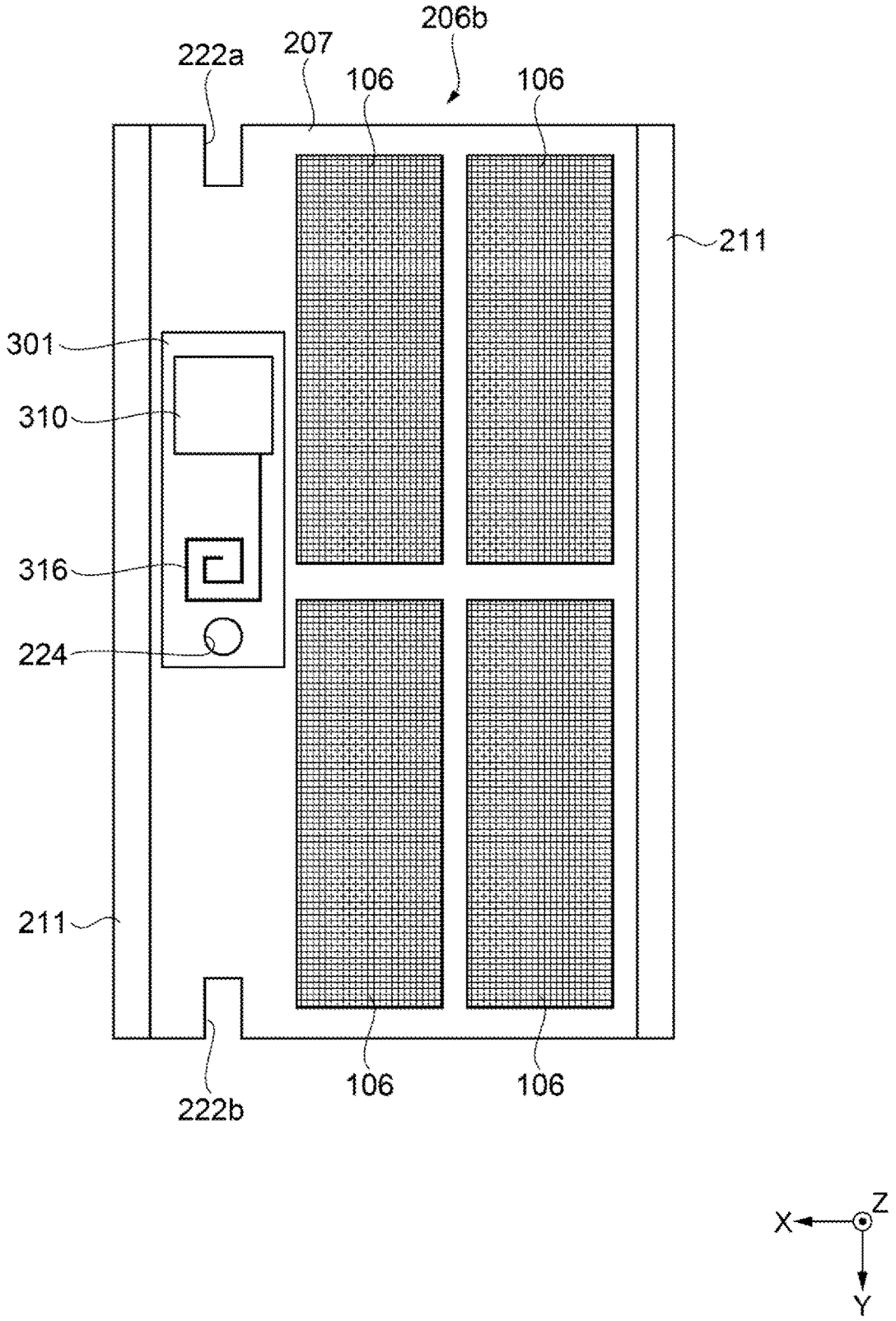
FIG. 12 is a plan view illustrating a configuration of a filter unit according to Modified Example 2.

In the above-described exemplary embodiments, the storage element 310 and the control unit 14 were coupled by wiring, but the invention is not limited thereto. FIG. 12 is a plan view illustrating a configuration of a filter unit according to the modified example. As illustrated in FIG. 12, a filter unit 206*b* includes an antenna for wireless communication 316 coupled to the storage element 310. Additionally, the control unit 14 is installed with a transmission/reception unit capable of transmitting/receiving information to and from the antenna for wireless communication 316. In this way, the storage element 310 and the control unit 14 can be wirelessly connected without contact. Further, installation of the coupling portion 125 on the ultraviolet irradiation unit 154 side becomes unnecessary, and a configuration of the ultraviolet irradiation unit 154 can be simplified. Note that, configurations other than for the antenna for wireless communication 316 are similar to those in First Exemplary Embodiment, thus descriptions thereof will be omitted.

Modified Example 3

Figure 13:
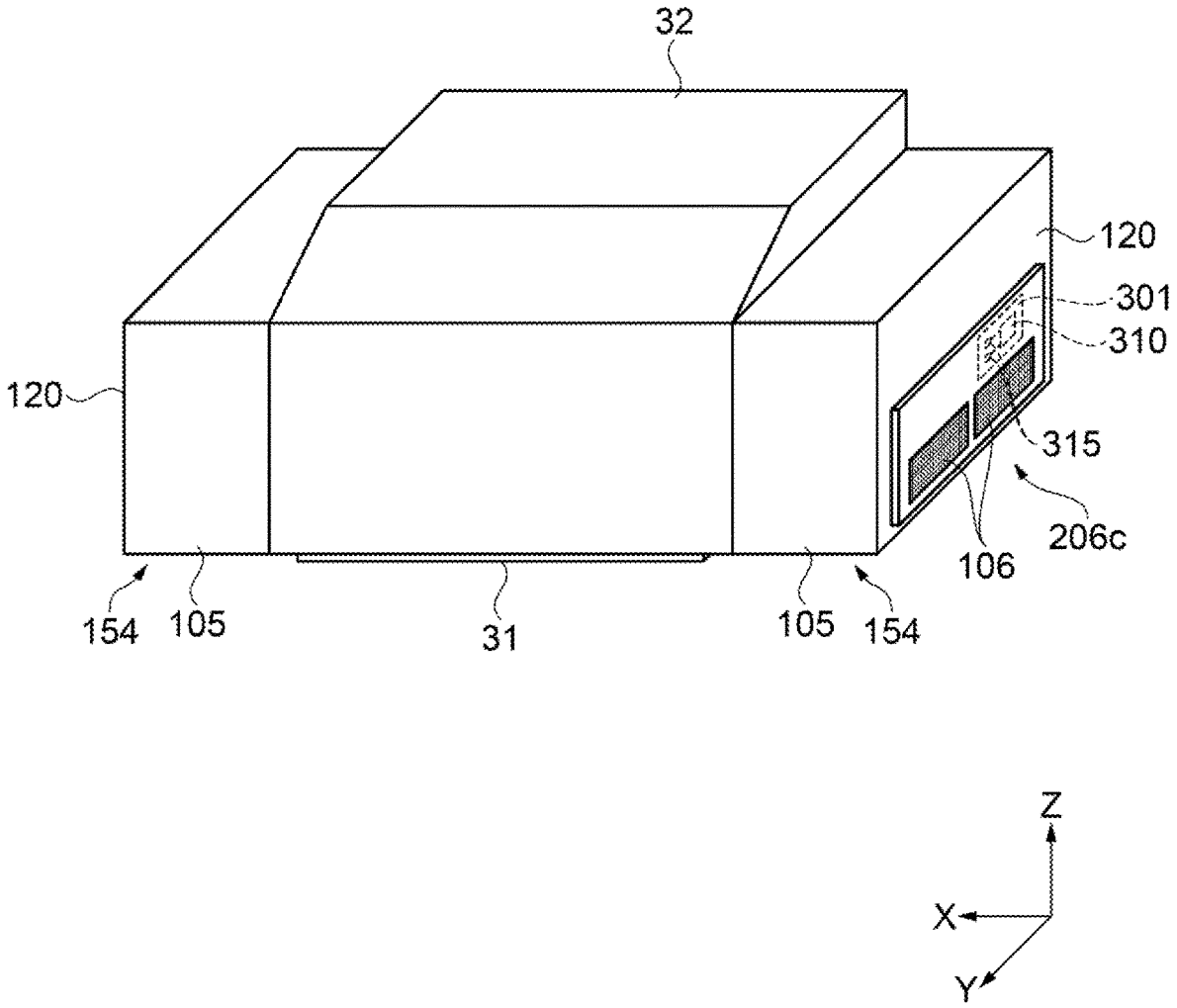
FIG. 13 is a perspective view illustrating a configuration of an ultraviolet irradiation unit according to Modified Example 3.

In the ultraviolet irradiation unit 154 in the above-described exemplary embodiments, the filter unit 206 was disposed on the upper part of the housing 120 (the inlet 104 side), but the invention is not limited thereto. FIG. 13 is a perspective view illustrating a configuration of an ultraviolet irradiation unit according to the modified example. As illustrated in FIG. 13, a filter unit 206*c* is disposed on a housing 120 portion of a side surface portion of the ultraviolet irradiation unit 154. Note that, in this case, an opening is formed on a portion to which the filter 106 of the filter unit 206*c* of the housing 120 corresponds. Additionally, in this case, the filter unit 206*c* may also be installed on the housing 120 according to a slide method of installing along a slide groove. Further, on the housing 120 side, the coupling portion 125 configured to be electrically coupled to the lands 315 coupled to the storage element 310 provided on the filter unit 206*c* is provided.

Additionally, the fan 103 is configured to be capable of switching between forward rotation drive and reverse rotation drive, and is set such that air intake from the filter 106 is possible. In this way, ink mists generated when the recording head 31 moves in the X axis direction can be collected efficiently from a side surface side of the ultraviolet irradiation unit 154.

Modified Example 4

In the above-described exemplary embodiments, the filter unit 206 was provided with the locating grooves 222*a*, 222*b* and the locating hole 224, and the locating pins 121*a*, 121*b*, and the locating pin 122 were installed on the housing 120 side, but the invention is not limited thereto. Instead of the above-described embodiments, a concave portion, a convex portion, or the like may be used. Even with this configuration, a coupling location between the filter unit 206 and the housing 120 can be defined.

Other Modified Examples

The above-described exemplary embodiments or the above-described modified examples may be appropriately combined and configured.

Additionally, the above-described exemplary embodiments were configured to include two ultraviolet irradiation units 154 adjacent both on a front side and a back side of the recording head 31, but a configuration in which only one ultraviolet irradiation unit 154 is included may be used.

Further, in the configurations of the above-described exemplary embodiments, the outlet 105 was disposed facing forward, but, for example, a configuration in which the outlet 105 is disposed facing forward and upward, that is, facing obliquely upward may be used.

Note that, in the printer 1 in the above-described exemplary embodiments, the ultraviolet cure type ink was used, but as an electromagnetic wave cure type ink, ink that cures by being irradiated with infrared rays, microwaves, or the like, may be used. Additionally, as ink, not only the electromagnetic wave cure type ink, but also a general aqueous ink and a solvent ink, a gel ink, a hot-melt ink, or the like may be applied.

Additionally, in the above-described exemplary embodiments, the printer that discharges ink was described, but an embodiment in which liquid (droplets) other than ink is discharged (or ejected) may be adopted. For example, a printer may be adopted that discharges liquid (functional liquid) including materials such as an electrode material and a color material used in manufacture of liquid crystal displays, electroluminescent (EL) displays, surface emitting displays, color filters and the like in a dispersed or dissolved form.

Additionally, a printer discharging bioorganic substances used for biochip manufacturing, a printer used as a precision pipette and discharging liquid to be a sample, a printing apparatus, a micro dispenser, or the like may be used.

Further, the invention may be appropriately applied to a printer discharging lubricant to a precision machine such as a clock or a camera in a pinpoint manner, a printer discharging transparent resin liquid such as ultraviolet cure resin or the like on a substrate for forming a tiny hemispherical lens (optical lens) or the like used for an optical communication element and the like, and a printer discharging etching liquid such as an acid or an alkali for etching a substrate or the like.

Note that, as a configuration in which liquid is discharged, a configuration in which liquid is discharged such that the liquid flies in a granular state, a configuration in which liquid is discharged such that the liquid flies in a teardrop state, a configuration in which liquid is discharged in a state where the liquid flies drawing a string tail, and the like are supposed.

Additionally, as liquid, a liquid material that can be discharged from a liquid discharging device may be used. For example, fluid such as liquid with high or low viscosity, sol, gel water, or other inorganic solvents, an organic solvent, a solution, a liquid resin, a liquid metal (a metallic melt), and not only liquid as a state of a substance, but also liquid in which particles of functional materials formed of solid materials such as pigments and metallic particles are dissolved, dispersed, or mixed in a solvent, or the like, are supposed.

Content derived from the exemplary embodiments will be described below.

A filter unit is a filter unit disposed in a printer provided with a control unit, and includes a filter configured to trap a foreign material, a frame configured to hold the filter, and a storage element provided on the frame and capable of transmitting/receiving information about the filter to and from the control unit.

According to this configuration, it is easy to acquire the information about the filter via the storage element. For example, by acquiring the cumulated time that the filter is used, when a predetermined cumulated time is reached, the filter can be replaced. Accordingly, it is possible to easily grasp when to replace the filter. In this case, for example, it is possible to maintain the cooling efficiency of the ultraviolet irradiation part, and prevent deterioration of the ultraviolet irradiation part, by installing a filter on the ultraviolet irradiation unit, and making the filter replaceable at an appropriate time.

In the above-described filter unit, the frame is preferably formed in a rectangular shape, and the filter and the storage element are preferably disposed in parallel along a short-side direction.

According to this configuration, the filter and the storage element can be efficiently disposed on the frame.

In the above-described filter unit, a coupling portion electrically coupled to the storage element, and configured to be electrically coupled to the control unit is preferably disposed at a central portion in a long-side direction of the frame.

According to this configuration, even when the frame is rotated by 180 degrees, the coupling portion is located at a central portion of the frame in the long-side direction, thus, for example, when the respective filter units are installed on two locations in the printer, both the filter units can be used, and convenience for a user can be enhanced.

A light source unit is a light source unit disposed in a printer including a control unit, and includes a housing, a light source disposed in the housing and configured to radiate ultraviolet rays, a driving circuit configured to drive the light source, a temperature detecting element configured to measure an ambient temperature of the light source, and a storage element capable of transmitting/receiving information about the light source to and from the control unit. The housing includes an inlet configured to take in outside air and an outlet configured to discharge outside air taken in, and the storage element is disposed on the inlet side of the light source.

According to this configuration, it is easy to acquire the information about the light source via the storage element. Additionally, information about the ambient temperature of the light source can be easily acquired by the temperature detecting element. Accordingly, for example, the light source can be replaced according to the cumulated operation time that the light source is operated and the ambient temperature of the light source. Accordingly, it is easy to grasp when to replace the light source. Additionally, it is possible to maintain quality of the light source, and improve image quality.

In the above-described light source unit, the temperature detecting element is preferably disposed on the outlet side of the light source.

According to this configuration, the temperature detecting element is less susceptible to influence of outside air taken in the housing, and the ambient temperature of the light source can be reliably detected.

The printer includes the above-described filter unit or the above-described light source unit.

According to this configuration, it is easy to grasp when to replace the filter or the light source, and enhance convenience for a user.

This application claims priority under 35 U.S.C. § 119 to Japanese Patent Application No. 2018-030480, filed Feb. 23, 2018. The entire disclosure of Japanese Patent Application No. 2018-030480 is hereby incorporated herein by reference.

What is claimed is:

1. A filter unit disposed in a printer including a control unit, the filter unit comprising:

a filter configured to trap a foreign material;

a frame configured to hold the filter; and a storage element provided on the frame and capable of transmitting/receiving information about the filter to and from the control unit, wherein the frame is formed in a rectangular shape, and the filter and the storage element are disposed in parallel along a short-side direction, and wherein a coupling portion configured to be electrically coupled to the storage element, and electrically coupled to the control unit, is disposed at a central portion in a long-side direction of the frame.

2. A light source unit disposed in a printer including a control unit, the light source unit comprising:

a housing;

a light source disposed in the housing and configured to radiate an ultraviolet ray;

a driving circuit configured to drive the light source;

a temperature detecting element configured to measure an ambient temperature of the light source; and a storage element capable of transmitting/receiving information about the light source to and from the control unit, wherein the housing includes an inlet configured to take in outside air and an outlet configured to discharge outside air taken in, and the storage element is disposed closer to the inlet than to the light source.

3. The light source unit according to claim 2, wherein the temperature detecting element is disposed closer to the outlet than to the light source.

4. A printer, comprising:

the filter unit according to claim 1 or the light source unit according to claim 2.

* * * * *